US005920184A

United States Patent [19]

Kadanka

[11] Patent Number: 5,920,184

[45] Date of Patent: Jul. 6, 1999

[54] LOW RIPPLE VOLTAGE REFERENCE CIRCUIT

[75] Inventor: Petr Kadanka, Rosnov pod Radhostem, Czechoslovakia

[73] Assignee: Motorola, Inc., Schaumburg, Ill.

[21] Appl. No.: 08/841,874

[22] Filed: May 5, 1997

[51] Int. Cl.[6] ..... G05F 3/30

[52] U.S. Cl. ..... 323/314; 323/907

[58] Field of Search ..... 323/313, 314, 323/316, 907

[56] References Cited

U.S. PATENT DOCUMENTS

| | | | |
|---|---|---|---|
| 4,656,415 | 4/1987 | Draxelmayr | 323/907 |
| 4,896,094 | 1/1990 | Greaves et al. . | |
| 5,072,136 | 12/1991 | Naghshineh | 307/455 |
| 5,153,456 | 10/1992 | Keown | 307/443 |
| 5,604,427 | 2/1997 | Kimura | 323/313 |
| 5,629,612 | 5/1997 | Schaffer | 323/313 |
| 5,656,927 | 8/1997 | Wilhelm et al. | 323/313 |
| 5,666,046 | 9/1997 | Mietus | 323/313 |
| 5,760,639 | 6/1998 | Hall | 323/314 |

OTHER PUBLICATIONS

U. Tietze & Ch. Schenk, "Halbleiter–Schaltungstechnik", Springer–Verlag, 1993, pp. 558–559.

P. Horowitz & W. Hill, "The Art of Electronics", Cambridge Univ. Press, 1989, pp. 335–338.

*Primary Examiner*—Peter S. Wong

*Assistant Examiner*—Derek J. Jardieu

*Attorney, Agent, or Firm*—Rennie William Dover; Bob Handy

[57] ABSTRACT

A first current (Iptat) having a magnitude proportional to absolute temperature is passed through a resistor (R3) and a PN-junction (QA) to produce first and second voltages (Vr+Vbe) having, respectively, positive and negative temperature coefficients which when summed provide a temperature stabilized internal reference voltage (Vbgrl). This internal reference voltage (Vbgrl) powers the current generator for currents (I1, 12)) which pass through a second resistor (R8, R9) and a second PN junction (Q20A, Q20B) to produce third and fourth voltages having respectively, positive and negative temperature coefficients which when summed provide a temperature stabilized external reference voltage (Vbgrl) having improved ripple rejection. There is no feedback from the external reference voltage (Vbgr2, V-out) to the first current (Iptat) generator (42).

13 Claims, 2 Drawing Sheets

LOW RIPPLE VOLTAGE REFERENCE CIRCUIT

FIELD OF THE INVENTION

The present invention relates to electronic circuits for providing a reference voltage, especially, those using the energy band-gap voltage of a semiconductor device.

BACKGROUND OF THE INVENTION

It is common in the electronic arts to use reference voltages in connection with complex circuits and systems. Various circuits for generating reference voltages are well known, including those which employ temperature compensation so that the reference voltage is substantially independent of temperature over a significant range. It is also known to use cascaded voltage reference circuits.

However, these prior art circuits suffer from a number of limitations and disadvantages. For example, the ripple rejection is often not as large as is desired. Also, many prior art voltage reference circuits are very complex and occupy larger circuit area than is desired. These problems are exacerbated when it is desired that the reference voltage be small, e.g., close to the semiconductor band-gap voltage Vbg (Vbg for silicon=1.22 volts at zero Kelvin).

Accordingly, there is an ongoing need to have voltage reference circuits which overcome these and other deficiencies well known in the art, especially, circuits which provide improved ripple rejection while occupying comparatively small chip area.

DETAILED DESCRIPTION OF THE PREFERRED EMBODIMENT

Figure 1:
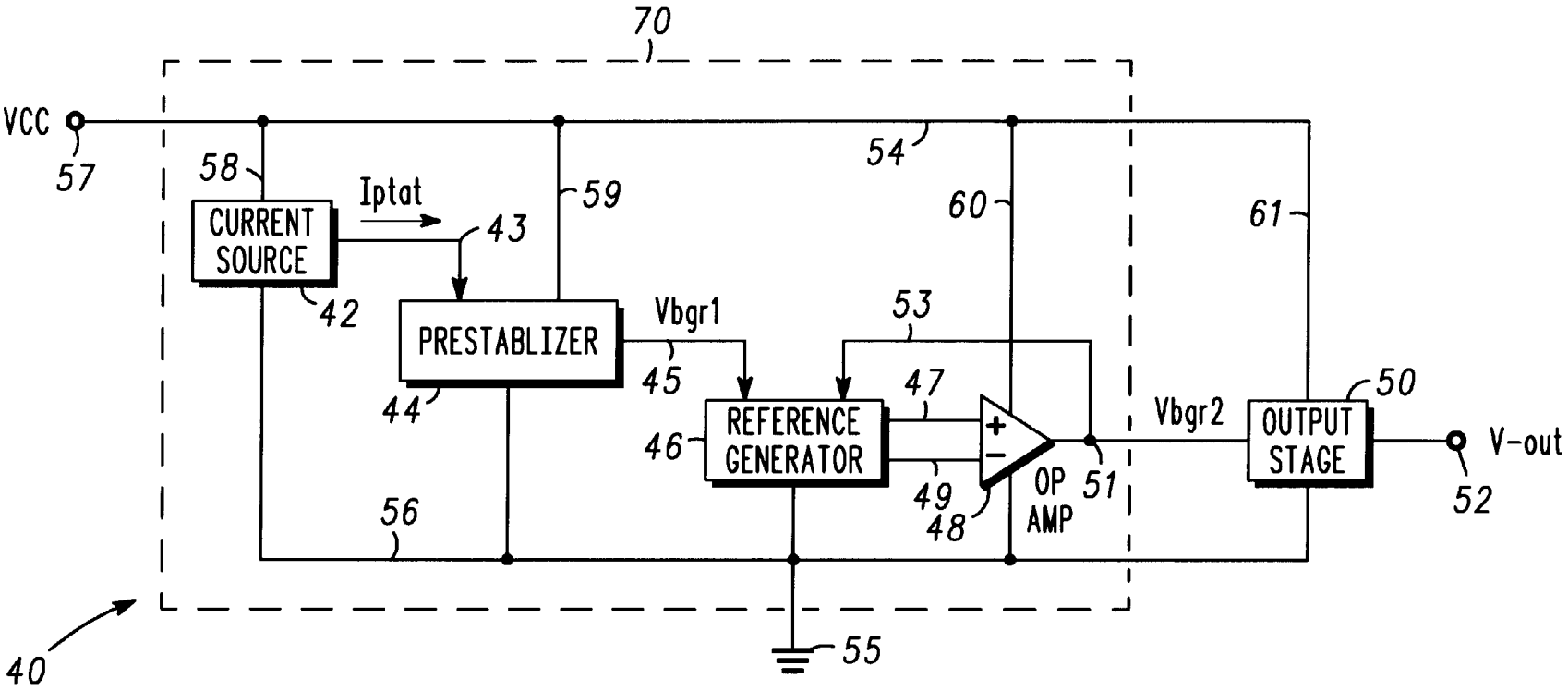
FIG. 1 is a simplified schematic block diagram of a voltage reference circuit according to the present invention.

FIG. 1 is a simplified schematic block diagram of voltage reference circuit 40 according to the present invention. Circuit 40 has current source 42, prestabilizer 44, reference generator 46, feed-back op-amp 48 and optional output stage 50. Circuit 40 receives VCC at node 57 which is distributed via line 54 and receives reference potential (e.g., GND) at node 55 which is distributed via line 56.

Current source 42 receives power from VCC line 54 via lead 58 and provides substantially constant currant Iptat on its output lead 43 coupled to prestabilizer 44. Current source 42 is conventional. Prestabilizer 44 receives power from VCC line 54 via lead 59 and provides Vbgr1 on output lead 45 coupled to reference generator 46. Prestabilizer 44 functions as a current-to-voltage converter whose output voltage is temperature stabilized and substantially constant and only weakly dependent on temperature.

Generator 46 receives power from prestabilizer 44. Reference generator 46 is coupled by lines 47, 49 to op-amp 48 which provides feedback via line 53 to reference generator 46 to assist in stabilizing its output. Op-amp 48 is coupled to VCC line 54 via lead 60 and to reference potential line 56. Op-amp provides output Vbgr2 on out-put node 51. Line 53 provides feedback from op-amp 48 to reference generator 46 to assist in stabilizing its output. Vbgr2 is coupled to optional output stage 50. Output stage 50 receives power from VCC line 54 via lead 61 and provides V-out proportional to Vbgr2 on output lead 52. Vbgr2 and V-out are temperature stabilized and substantially constant and only weakly dependent on temperature.

Source 42, prestabilizer 44, generator 46. op-amp 48 and output stage 50 are desirably coupled to ground connection 55 by line 56. In the preferred embodiment of the present invention there is no feedback from Vbgr2 or V-out to current source 42. Also, in the preferred embodiment, there is no feedback from Vbgr2 or V-out to prestabilizer 44. Current source 42 and prestabilizer 44 operate directly from VCC-GND and, preferably, independently of Vbgr2 and V-out, although feedback therefrom is not precluded. In the preferred embodiment, Vbgr1 and Vbgr2 are generated using PN junctions to provide the underlying reference potential and compensation is provided to overcome the inherent temperature variation of the PN junction voltage (e.g., −2 mv/degree C. for silicon).

Figure 2:
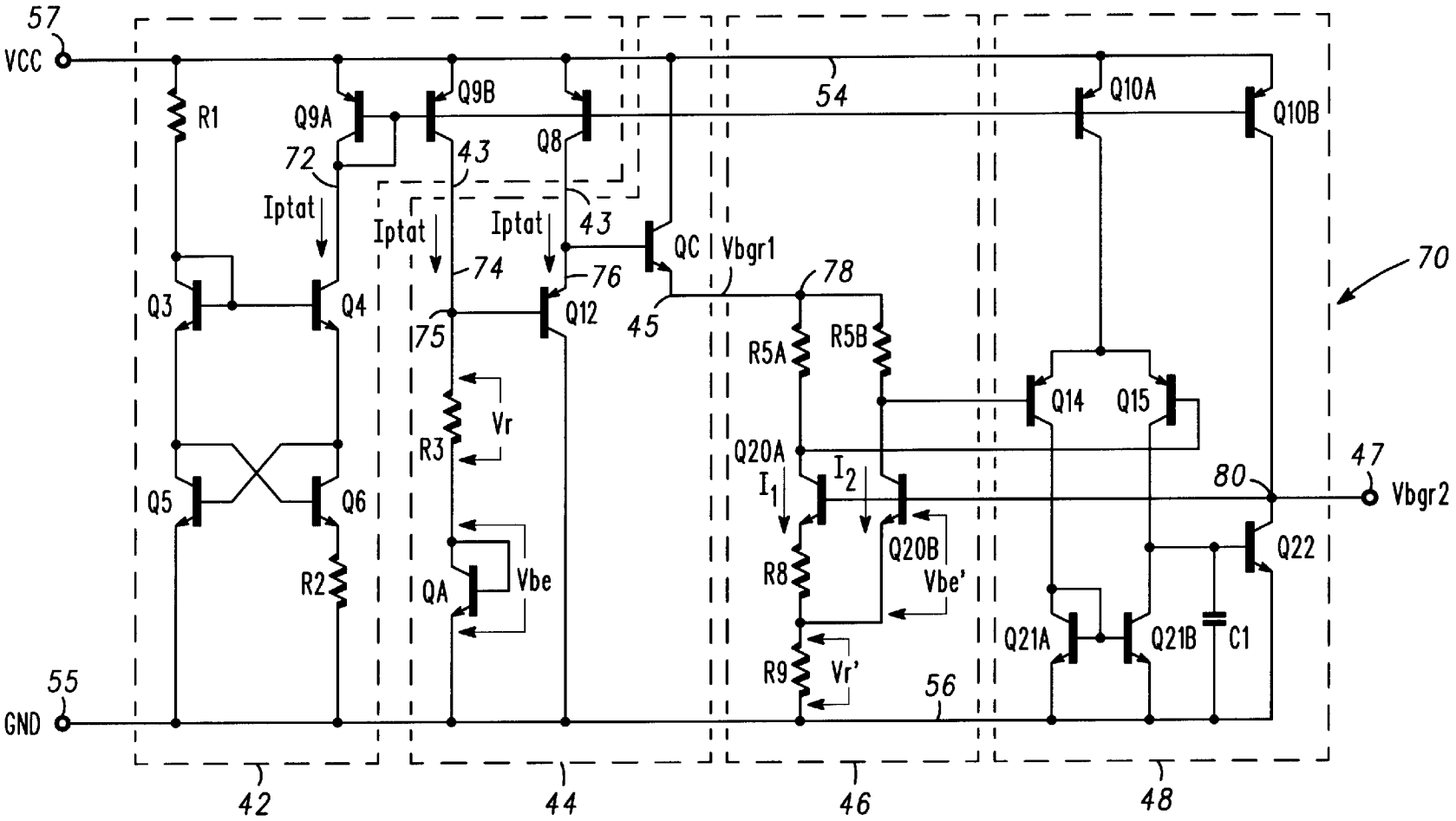
FIG. 2 is a simplified circuit diagram of a portion of the voltage reference circuit of FIG. 1 showing further details.

FIG. 2 is a simplified circuit diagram of portion 70 of voltage reference circuit 40 of FIG. 2 showing further details. The same reference numbers are used to identify like or analogous elements.

In the preferred embodiment, current source 42 comprises resistors R1 and R2, and transistors Q3, Q4, Q5, Q6, Q9A, Q9B and Q8, coupled as shown. Transistors Q3 and Q9A have their collectors and bases shorted and function as base-emitter diodes. Current source 42 produces current Iptat flowing in leads 72, 74, 76, where leads 74, 76 comprise output 43. Current source 42 derives power from VCC and GND leads 54, 56, respectively. The bases of Q8, Q9A, Q9B, Q10A, and Q10B are tied together. These transistors function as emitter followers.

In the preferred embodiment, prestabilizer 44 is desirably a band-gap reference circuit, comprising resistor R3, transistor QA (with collector-base shorted so that it functions as a base-emitter diode), transistor QC and transistor Q12. Prestabilizer 44 receives Iptat from current source 42 on leads 74, 76. Current Iptat flows through resistor R3 thereby producing positive temperature coefficient voltage Vr across resistor R3. Current Iptat also flows through the base-emitter PN-junction of device QA, thereby producing negative temperature coefficient voltage Vbe across device QA. Voltages Vr and Vbe are summed at node 75 thereby producing Vbgr1 which is transferred by emitter followers Q12 and QC so as to appear at output 45 of prestabilizer 44 and at input node 78 of band-gap reference generator 46. With the combination of one resistor R3 and one PN-junction QA, and assuming that the semiconductor employed is silicon, Vbgr1 is about 1.25 volts. The observed value of Vbgr1 is 1.15<Vbgr1<1.30 volts for temperature T in the range −40<T<+125 degrees C.

While it is very convenient for low voltage applications to have Vbgr1 be about 1.25 volts, this is not essential and multiples thereof are easily provided by adding N transistors $(QA)_N$ in series in place of QA and adjusting the total series resistance value $(R)_N$=N*R3 so that Vbgr1=N(Vr+Vbe).

Prestabilizer 44 illustrated in FIG. 2 is especially simple and uses very little circuit area because of the small number of elements used to implement it. It also produces a low reference voltage (e.g.,~1.25v) which is especially useful in low power portable applications. It will be noted that buffer transistors Q12 and QC are of opposite type so that the Vbe of Q12 and Vbe of QC are of opposite polarity and substantially cancel. Thus, the temperature compensated voltage at node 75 is transferred to node 78 substantially unchanged.

In the preferred embodiment, reference generator 46 is also desirably a band-gap reference circuit, comprising input node 78, resistors R5A, R5B, R8, R9 and transistors Q20A, 20B, coupled as shown in FIG. 2. It is desirable that the emitter of Q20A have N times the area of the emitter of transistor Q20B, where N is usefully in the range 2<N<100 and preferably in the range 4<N<10.

The current I1+I2 flowing through resistor R9 provides Vr' with a positive temperature coefficient, and the voltage on the base-emitter junction of transistor Q20B provides negative temperature coefficient voltage Vbe'. These two voltages are summed at node 80 to provide Vbgr2=Vr'+Vbe' of about 1.25 volts which is temperature stabilized and which varies only slightly with temperature. The observed value of Vbgr2 is about 1.21<Vbgr2<1.25 volts for temperature T in the range −40<T<+125 degrees C.

Transistors Q10A, Q10B, Q14, Q15, Q21A, Q21B, Q22 form op-amp 48 which keeps substantially equal currents I1, I2 flowing through transistors 20A, 20B. Transistor Q22 is an emitter follower stage which provides drive for output stage 50. Optional capacitor C1 rolls off the high frequency response of output amplifier Q22 so that high frequency oscillation is avoided.

Optional output stage 50 provides additional drive capability to handle the load which is to be presented by the circuit or system (not shown) that uses V-out. V-out can be larger or equal to Vbgr2, according to the needs of the user, but is determined by Vbgr2 so as to provide a substantially temperature independent and constant voltage reference. Output stage 50 is conventional.

Having described the invention, it will be apparent to those of skill in the art, that current source 42 is a voltage to current converter which produces a substantially constant current Iptat but which is nevertheless temperature dependent with a positive temperature coefficient. The magnitude of Iptat can be arranged to depend substantially only on the ratio of the emitter areas of transistors Q5, Q6. The area ratio Q6/Q5 must be greater than 1, generally greater than 2 and preferably in the range 2<(Q6/Q5)<10.

While the arrangement of current source 42 illustrated in FIG. 2 is preferred, those of skill in the art will understand based on the description herein that any circuit capable of producing Iptat can be used instead of the illustrated arrangement. However, it is desirable that there not be feedback from the voltage reference output Vbgr1 or Vbgr2 or V-out to current source 42 and that current source 42 derive its power from the DC power supply lines of VCC-GND or equivalent rather than Vbgr1 or Vbgr2 or V-out.

Similarly, while the arrangement illustrated in FIG. 2 for providing prestabilizer 44 is preferred, any arrangement which converts a current into a reference voltage Vbgr1 which has a substantially constant value with little or no temperature variation can also be used and the term Vbgr1 is intended to include such variations whether based on a band-gap voltage or not. While Vbgr1 is derived by use of the PN junction voltage of device QA, any other means of generating a substantially stable reference voltage can also be used. It is desirable that there not be feedback to prestabilizer 44 from Vbgr2 or V-out, or from Vbgr1 to current source 42. It is also desirable that prestabilizer 44 use as few components as possible so as to not add significant additional circuit area.

It has been found that the arrangement depicted in FIGS. 1–2 provides substantially improved ripple rejection, that is, the amount of power supply variations and other noise that appears on Vbgr2 or V-out. For example, with a conventional feedback system for generating a reference voltage, the low frequency ripple rejection is of the order of 65 dB which is typical of many prior art systems. However, with the arrangement of the present invention, shown by way of example in FIGS. 1–2, the low frequency ripple rejection is about 85 dB. This improvement over the prior art is of great practical significance, since systems are often very susceptible to ripple or other noise on the reference voltage lines. In some cases excessive ripple or other noise on the reference voltage can cause system malfunctions.

A further advantage of the present arrangement is that no frequency compensation or stabilization is required for the prestabilizer portion of the present circuit.

A still further advantage of the present invention is that prestabilizer circuit 44 requires very few additional components while imparting significantly improved ripple rejection. In circuit 70 illustrated in FIG. 2 there are 27 elements of which prestabilizer 44 requires 4, or about 15% of the circuit elements in the basic voltage reference generator. Compared to the overall integrated circuit of which circuit 70 forms but a part, the additional chip area required to obtain the improved ripple rejection is negligible. Having reduced ripple rejection on the voltage reference line removes the need for other stabilization or filtering or voltage guard-bands elsewhere in the overall integrated circuit chip. This is of great practical significance because of the well known relationship between integrated circuit complexity, area and cost, the greater the complexity, the greater the area and the greater the cost.

Having described the invention, those of skill in the art will understand that modifications and substitutions can be made for various elements of the invention without departing from the scope thereof as defined by the claims that follow. Non-limiting examples of such alternatives are use of other types of semiconductor or other electronic devices and use of other forms of current sources and reference voltage generators for the prestabilizer and reference generator portions of the present invention than those illustrated herein. A further example is that voltages Vr and Vr' having positive temperature coefficients can be produced in other ways than merely by use of currents having a positive temperature coefficients. For example, the resistors used to generate Vr or Vr' can have positive temperature coefficients while I is temperature independent or only weakly positive or even negative, so long as the products I*R=Vr and I'*R'=Vr' have positive temperature coefficients of sufficient magnitude to compensate Vbe and Vbe' so that Vbgr1 and Vbgr2 have reduced temperature sensitivity.

Accordingly, it is the intention to include these and other variations and substitutions as will occur to those of skill in the art in the claims that follow.

I claim:

1. A voltage reference circuit having an output, comprising:

a current source for providing a first current;

a prestabilizer circuit for receiving said first current and producing therefrom a temperature stabilized first reference voltage;

a reference generator circuit for receiving said first reference voltage and producing therefrom a second current used to produce a second temperature stabilized reference voltage at the output; and wherein the prestabilizer circuit comprises a resistor for generating a positive temperature coefficient voltage and a PN junction for generating a negative coefficient voltage, wherein these two voltages are summed at a node to produce the first reference voltage which is coupled to the reference generator circuit via an even number of emitter follower stages whose summed base-emitter voltages substantially cancel.

2. The circuit of claim 1 wherein said temperature stabilized first reference voltage has a positive temperature coefficient.

3. The circuit of claim 1 wherein said second temperature stabilized reference voltage has a power supply ripple rejection ratio greater than 65 dB.

4. A voltage reference circuit having an output, comprising:

a current source producing a first current;

a first current-voltage converter for producing from said first current a first voltage which increases with temperature and a second voltage which decreases with temperature and having a node wherein the first and second voltages are combined to provide a first reference voltage substantially independent of temperature over a first predetermined temperature range, wherein the first reference voltage is coupled to an output of the first current-voltage converter via an even number of emitter follower stages whose summed base-emitter voltages substantially cancel;

a voltage-current converter for receiving said first reference voltage from said first current-voltage converter and producing therefrom a second current; and a second current-voltage converter for producing from said second current a third voltage which increases with temperature and a fourth voltage which decreases with temperature and having a node wherein said third and fourth voltages are combined to provide a second reference voltage substantially independent of temperature over a second predetermined temperature range.

5. The circuit of claim 4 wherein said voltage-current converter comprises parallel coupled branches, each branch carrying substantially equal currents.

6. The circuit of claim 5 wherein said second current-voltage converter comprises parallel arranged base-emitter diodes producing said voltages which increase with temperature.

7. The circuit of claim 4 wherein there are an equal number of transistors of each conductivity type in said emitter follower stages.

8. The circuit of claim 4 wherein said second reference voltage has a power supply ripple rejection ratio greater than 65 dB.

9. A voltage reference circuit having connections for a power supply, comprising:

a first current source for operating from the power supply to provide a first current;

a first resistor and a first PN-junction coupled to the first current source to produce first and second voltages having, respectively, positive and negative temperature coefficients;

a first node for summing the first and second voltages to provide a temperature stabilized internal reference voltage;

a second current source receiving the temperature stabilized internal reference voltage from the first node via an even number of emitter follower stages whose summed input-output voltage drops substantially cancel, to provide a second current;

a second resistor and second PN junction coupled to the second current source to produce third and fourth voltages having respectively, positive and negative temperature coefficients; and a second node for summing the third and fourth voltages to provide a temperature stabilized external reference voltage.

10. The circuit of claim 9 wherein the first and second currents have positive temperature coefficients.

11. The circuit of claim 9 wherein there are an equal number of transistors of each conductivity type in said emitter follower stages.

12. The circuit of claim 9 wherein the second node is coupled to parallel arranged base-emitter diodes.

13. The circuit of claim 9 wherein said second temperature stabilized external reference voltage has a power supply ripple rejection ratio greater than 65 dB.

* * * * *